United States Patent [19]

Lederer

[11] Patent Number: 4,617,614

[45] Date of Patent: Oct. 14, 1986

[54] ELECTRIC LIGHT FIXTURE

[76] Inventor: Gabor Lederer, 92 Kansas St., Hackensack, N.J. 07601

[21] Appl. No.: 776,384

[22] Filed: Sep. 16, 1985

[51] Int. Cl.[4] ..... F21P 1/02; F21V 35/00

[52] U.S. Cl. ..... 362/212; 362/392; 362/810; 362/447

[58] Field of Search ..... 362/212, 257, 353, 351, 362/392, 447, 810

[56] References Cited

U.S. PATENT DOCUMENTS

| | | | |
|---|---|---|---|
| 1,397,212 | 11/1921 | Herskovitz | 362/392 X |
| 1,974,077 | 9/1934 | Lynch | 362/353 X |
| 2,658,168 | 11/1953 | Matson | 362/810 X |
| 3,500,126 | 3/1970 | Ford | 362/392 X |
| 3,760,177 | 9/1973 | Levy | 362/392 X |
| 4,510,556 | 4/1985 | Johnson | 362/810 X |

*Primary Examiner*—Richard E. Gluck
*Attorney, Agent, or Firm*—Arnold D. Litt

[57] ABSTRACT

An electric light fixture and a programmable electronic circuit combined into a unitary structure to thus enable the operational modes of the electric light fixture to be preset. It is also so constructed that single fastening means removably secures the unitary structure to a supporting structure.

11 Claims, 5 Drawing Figures

ELECTRIC LIGHT FIXTURE

This invention relates to electric light fixtures, and more particularly, electric light fixtures which are programmable for automatic operation.

BACKGROUND OF THE INVENTION

One type of electric light fixture is known as an electric candle which is used as a church altar candle. A plurality of these electric candles are usually supported by a frame in a plurality of rows. Heretofore, such electric altar candle assemblies have had a programmable control center common to all the electric candles in the assembly for programming each electric candle to automatically turn-on and turn-off at selected, predetermined intervals. Since each electric candle must be connected to the control center through a great number of electrical leads, such assemblies have a relatively complex circuit requiring skilled persons for assembly and repair. These heretofore electric altar candle assemblies have also proven to be limited in the number of electric candles which can be incorporated in the assembly and limited in time-settings for the various individual electric candles in the assembly. In addition, these previously known electric altar candle assemblies required the light bulb socket, switch, connector and glass cover to be separately supported. Because of the electrical and mechanical complexity of these heretofore known electric altar candle assemblies, highly skilled persons are required to maintain, operate and repair such assemblies. These aforesaid disadvantages of known electric candles and assemblies thereof are overcome by the electric light fixtures according to the present invention.

It is therefore an object of this invention to provide an electric light fixture and a programmable electronic circuit combined into a unitary structure to thus enable the individual operational programming of such electric light fixture.

It is another object of this invention to provide a programmable electric light fixture of simple construction and capable of easy assembly, maintenance and repair by unskilled persons.

It is further object of the present invention to provide an electric light fixture capable of being arranged in an assembly of a plurality of electric light fixtures where the support and electrical interconnection of the plurality of electric light fixtures are relatively simple and wherein each of the electric light fixtures is individually programmable to switch-on and switch-off and to be set for the duration of the on and off operational modes.

SUMMARY OF THE INVENTION

Now, therefore, the present invention contemplates a novel electric light fixture comprising a circuit board of elongated configuration on which is supported a programmable electronic timer circuit. A light bulb receptacle is provided for receiving an electric light bulb which may be of the type which simulates an open flame. The light bulb receptacle is electrically connected to the programmable electronic timer circuit. The light bulb and the circuit board are supported on a bracket to form a unitary assembly.

In a narrower aspect of the invention, a single fastening means is provided to secure the bracket to a supporting structure.

In a still narrower aspect of the invention, a translucent sleeve is disposed to surround the circuit board, light bulb and bracket and is supported at one end to extend into the open end of a cup-shaped element which in turn is clamped between the bracket and the supporting structure by the aforesaid fastening means.

BRIEF DESCRIPTION OF THE DRAWINGS

The invention will be more fully understood from the following description when considered in connection with the accompanying drawings in which.

DESCRIPTION OF THE PREFERRED EMBODIMENT

Figure 1:
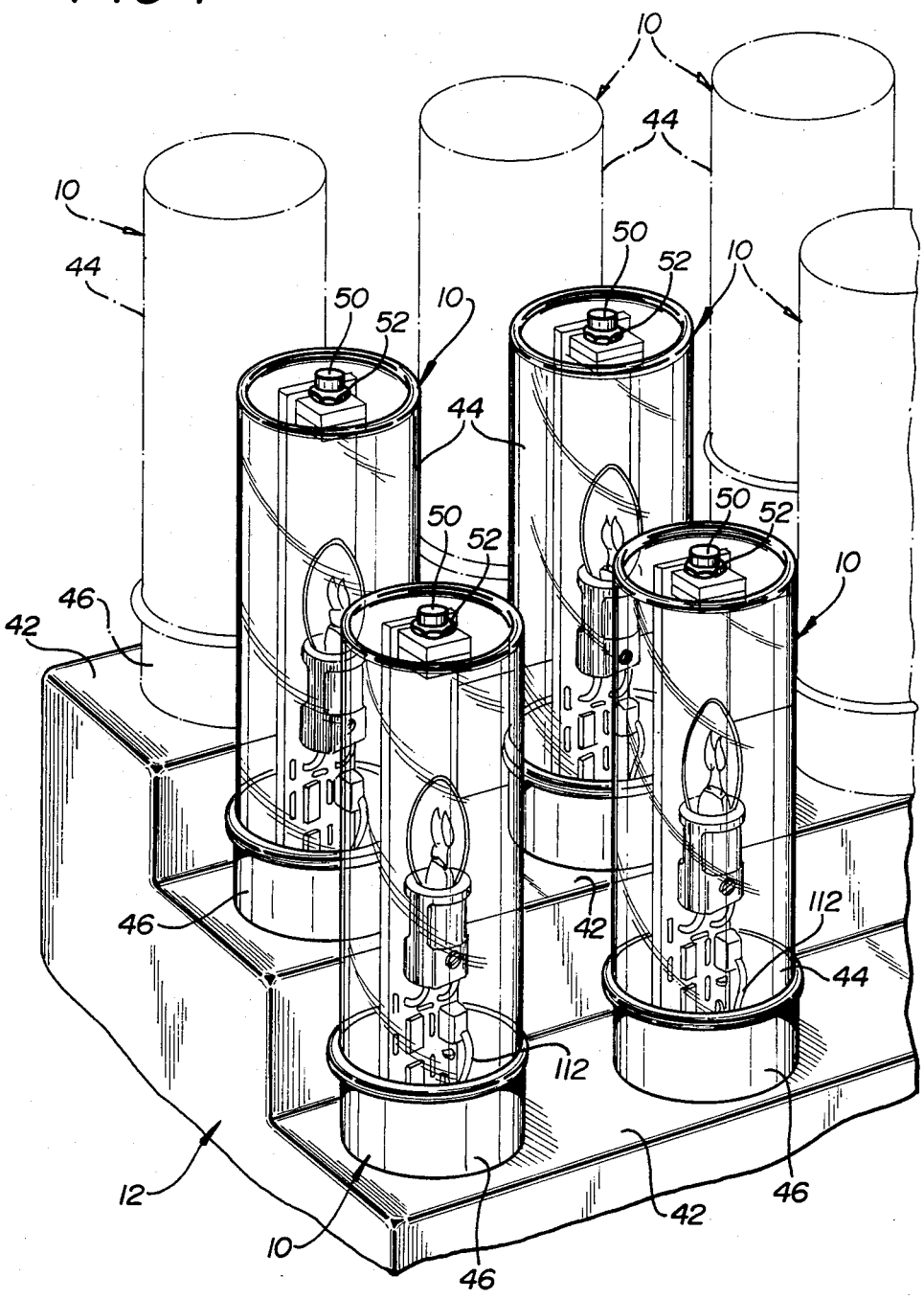
FIG. 1 is a fragmentary view of perspective of an assembly of electric candles according to this invention.

Now referring to the drawings and more specifically to FIGS. 1, 2 and 3, the reference number 10 generally designates the electric light fixture according to this invention which is shown in the drawings and will be described as an electric candle. One application of electric candles 10 is an arrangement as shown in FIG. 1 where a plurality of electric candles 10 are supported in rows by a base or supporting structure 12. In this application the candles are connected to a source of electric power 14 as shown schematically in FIG. 4. This assembly of electric candles 10 is facilitated by the novel construction of each electric candle 10 as will hereinafter be more fully explained.

Figure 2:
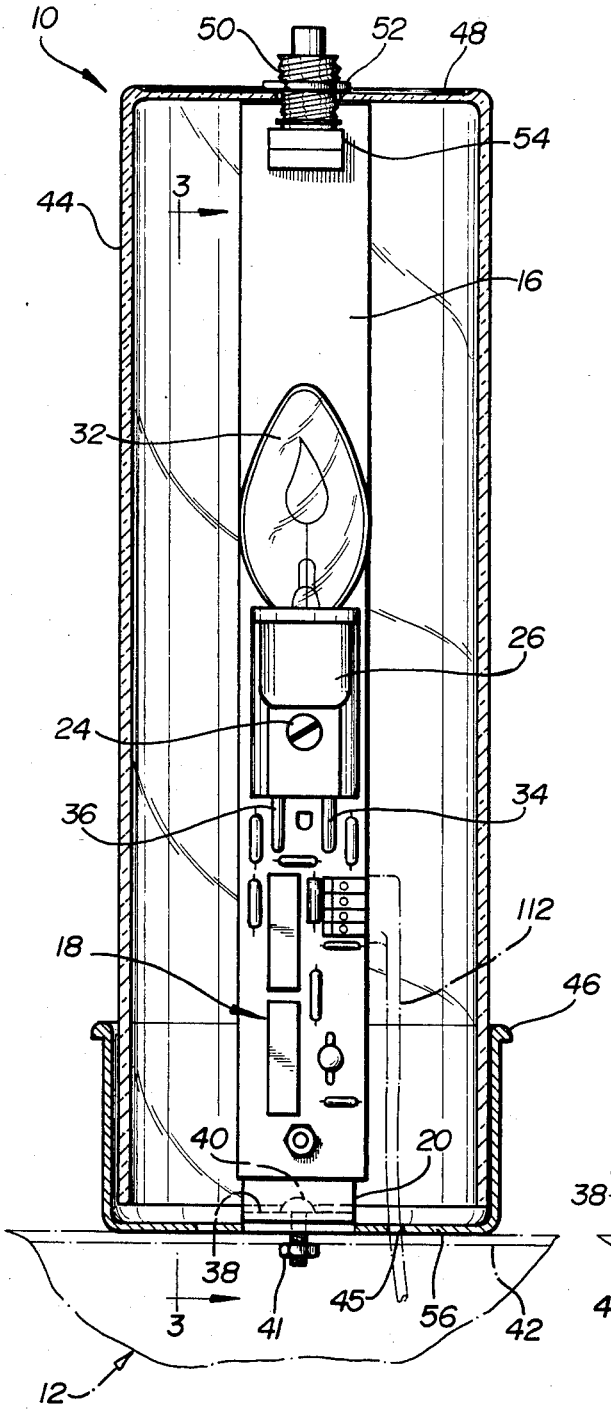
FIG. 2 is a view of cross-section through a cover subassembly and showing the inner subassembly in elevation.
Figure 3:
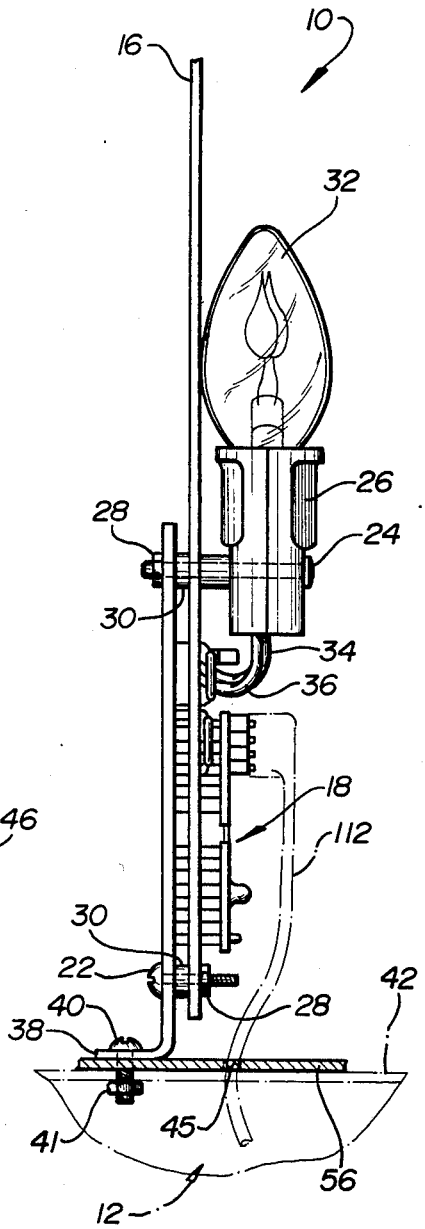
FIG. 3 is a cross-sectional view taken substantially along line 3—3 of FIG. 2.

As best shown in FIGS. 2 and 3, each electric candle 10 comprises a planar circuit board 16 of rectangular configuration which supports an electronic timer circuit 18 by which the associated electric candle can be programmed to switch-on and switch-off at predetermined intervals. The circuit board 16 is supported in a normally vertical orientation by a mounting bracket 20 and by suitable fastening means such as bolts 22 and 24. The bolt 22 passes through registered openings in bracket 20 and circuit board 16 while bolt 24 passes through a hole in the body of a light bulb receptacle 26 and aligned holes in circuit board 16 and mounting bracket 20. Nuts 28 are turned on the threaded shank portions of bolts 22 and 24 to secure circuit board 16 to mounting bracket 20. Bolt 24 and its associated nut 28 serve to secure not only circuit board 16 and bracket 20 together but light receptacle 26 to the circuit board 16. Spacer washers 30 may be placed on bolts 22 and 24 between circuit board 16 and bracket 20 to hold the bracket and circuit board in spaced, parallel relationship. The light bulb 32, which may be of the type that simulates an "open" candle flame, is receivable in receptacle 26 and, through the receptacle 26 and electric leads 34 and 36, is electrically connected to timer circuit 18. The bracket 20 has a flanged portion 38 which projects at right angles to the plane of bracket 16. The bracket 20 is dimensioned in length and is so positioned relative to circuit board 16 that flanged end portion 38 of bracket 20 lies in a plane beyond the lower end of circuit board 16. A threaded bolt 40 passes through aligned holes in flanges end portion 38 and a wall 42 which form part of supporting structure 12. By this single mounting bolt 40 and a nut 41 turned on to the bolt, or alternatively, bolt 40 turned into a threaded hole in wall 42, each of the electric candles 10 is secured to the supporting structure and are therefore quickly and easily removed and replaced.

Each of the electric candles 10 may also comprise a protective sheath subassembly. This protective subassembly as best shown in FIGS. 1 and 2, consists of a translucent or transparent sleeve 44 and a cup-shaped element 46. The sleeve 44 is closed at its upper end by a wall 48. The sleeve 44 is secured to as to surround and encase the bracket 20, circuit board 16, and light receptacle 26 by a fastening means comprising a threaded post 50 and a nut 52. The threaded post 50 is secured to a plate 54 which, in turn, is attached to the upper end of circuit board 16 and extends from the circuit board 16 in a plane normal to the plane of the circuit board. The post 50 extends upwardly through a centrally located hole in wall 48 with its lower open-end portion fitted within cup-shaped element 46. The cup-shaped element 46 is clamped to the assembly between flange 38 and wall 42 of supporting structure 12 by mounting bolt 40, which extends through a hole in the bottom wall 56 of element 46. The bottom wall 56 of element 46 is also provided with one or more openings 45 which register with openings in wall 42 of the support structure to permit electrical leads to extend from timer circuit 18 out of the electric candle 10, as is shown in dot-dash lines in FIGS. 2 and 3.

In an alternative arrangement, without departing from the scope and spirit of this invention, sleeve 44 may be suspended from the distal end portion of a modified bracket 20 which is of longer dimension than that shown and thereby extend to a point above a circuit board 16 terminating near light receptacle 26.

Figure 4:
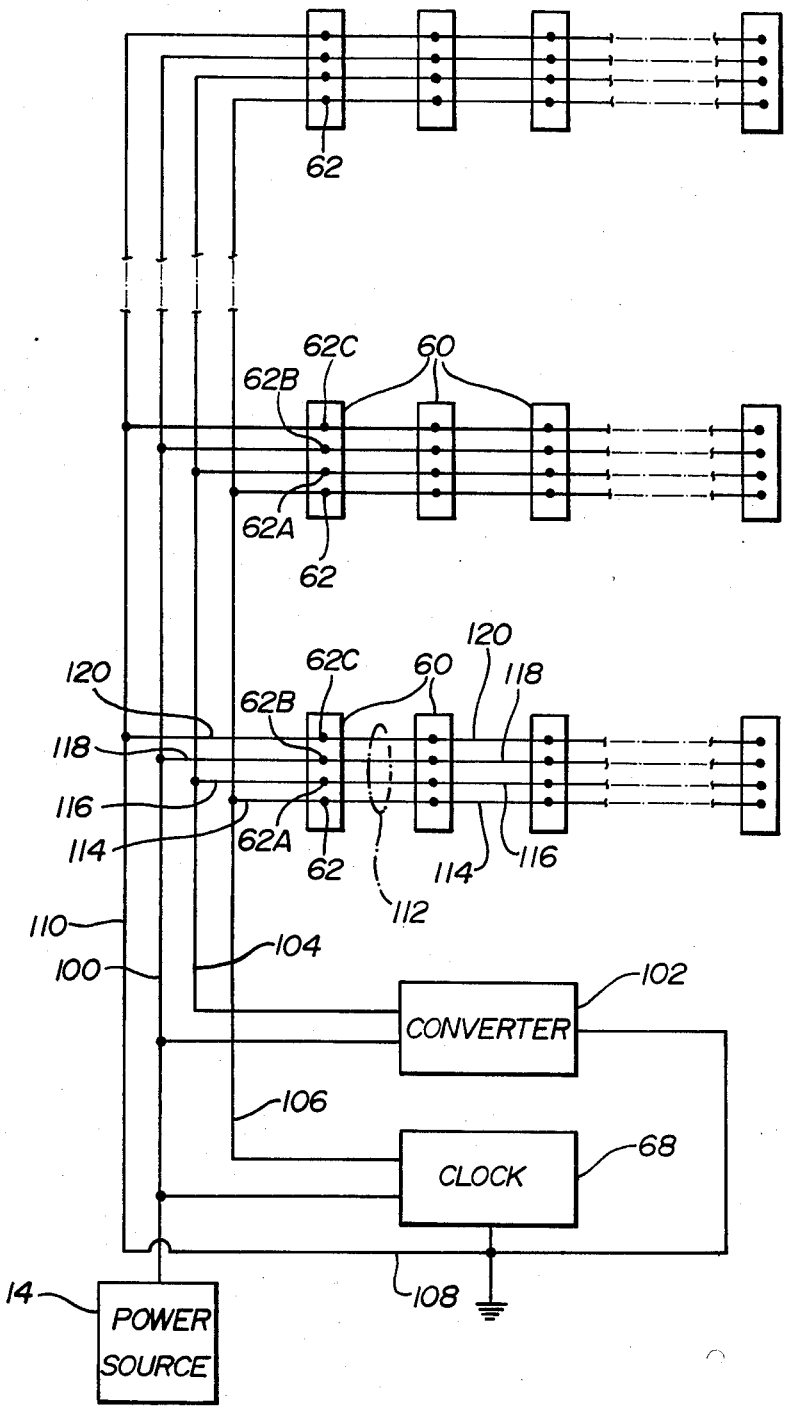
FIG. 4 is a wiring diagram showing how the electric candles of this invention are electrically interconnected in the assembly shown in FIG. 1.
Figure 5:
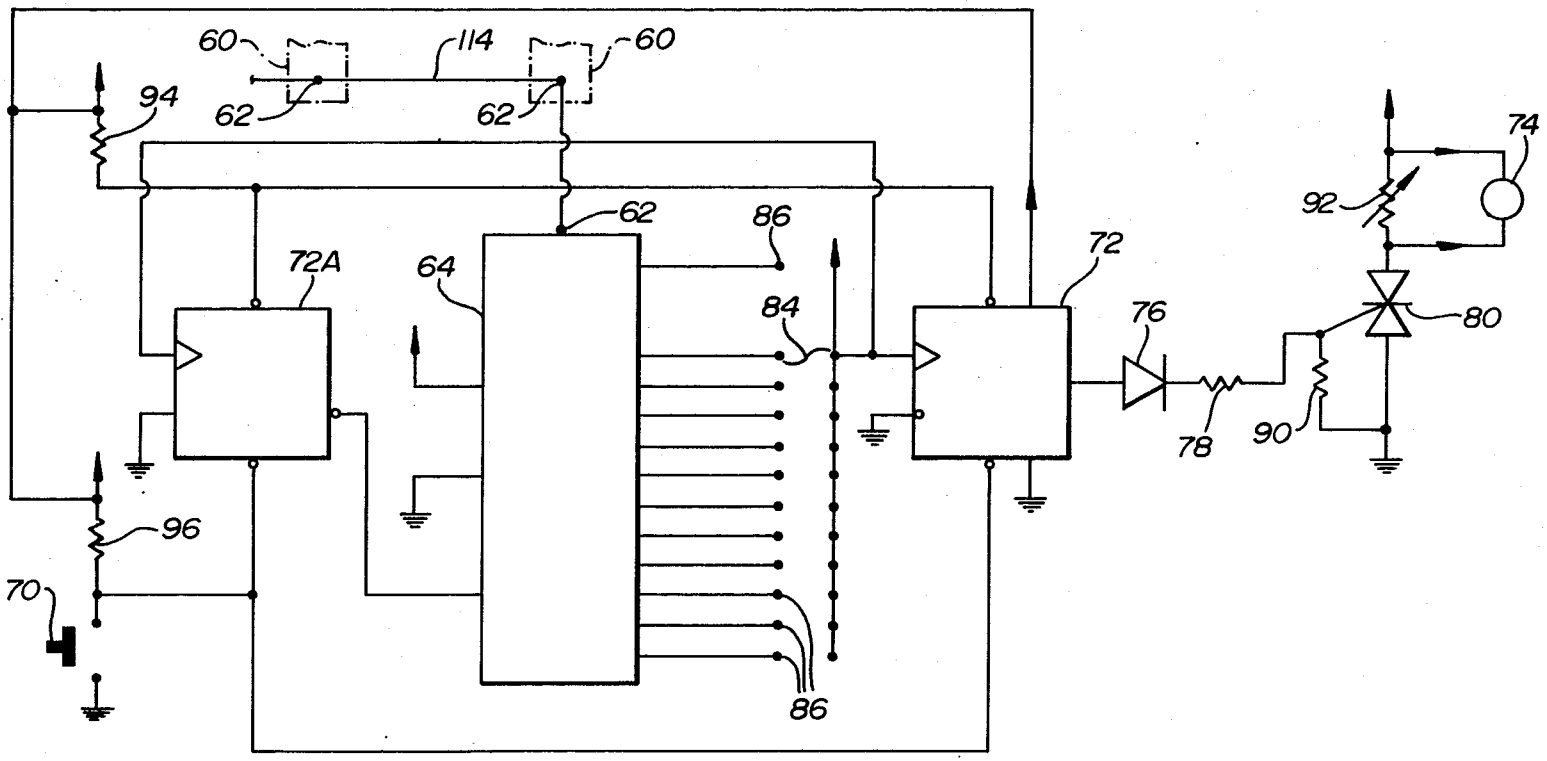
FIG. 5 is a wiring diagram of the programmable electronic timer circuit which forms a part of the electric candle according to this invention.

As shown in FIG. 5, timer circuit 18 comprises a terminal having a four post or pin connector 60. The post 62 of connector 60 communicates binary counter 64, via lines 114 and 106, to the power source 14 and clock 68 (see FIG. 4). A manually actuated switch 70, when closed, activates circuit 18 so that, through a dual flip-flop circuit which includes complementary flip-flop units 72 and 72A, a neon light 74 is caused to light, via a diode 76, resistor 78 and gate 80 of a switching triac. At the same time, flip-flop unit 72 will reset binary counter 64 and it will start to count incoming clock pulses. The binary counter 64 is preset or programmed by positioning of a movable contact switch 84 in engagement with any one of a plurality of stationary contacts 86. After the programmed lapse of time, the pulse will reset the dual flip-flop circuit to its original setting and switching triac will turn-off the neon light 80 and the binary counter 64 will be inactive for the selected time pulses. During the activated time, engaging switch 70 will have no effect on the circuit. Resistors 90, 92, 94 and 96, including resistor 78 are of selected values and function to set the static condition of circuit 18.

It is to be understood that the invention is not limited to timer circuit 18 shown in FIG. 5 and described herein. Any suitable timer circuit may be provided which enables electronic candle 10 to be programmed to switch-on and switch-off at predetermined selected intervals and which also provides no more than four electrical terminals.

When it is desired to connect electric candles 10 into an array or assembly as is shown in FIG. 1, each of the electric candles 10 is secured to the supporting structure 12 by mounting bolt 40 and electrically connected together as schematically shown in FIG. 4.

As illustrated in FIG. 4, each of the electric candles 10 shown in FIG. 1, are connected at their four terminals 62, 62A, 62B, and 62C of their associated connector 60 of timer circuit 18, in parallel to each other and to source of electric power 14 of 110 volts, via line 100, and a source of 5 volt AC electric power produced by converter 102, via line 104, to a clock 68 via line 106, and to a common ground 108 via line 110. The electric cable 112 has wires 114, 116, 118 and 120 which connect with terminals 62, 62A, 62B and 62C with the electric lines 106, 104, 100 and 110, respectively. This electrical interconnection of electric candles 10 imposes no limitation on the number of rows of electric candles nor on the number of electric candles in each row which may be provided in such assembly. Additionally, for repair, maintenance, adjustment or replacement, each electric candle can be removed and replaced mechanically as herein described and electrically be merely effecting disconnection and connection of a four-wire electric cable 112 from and to connector 60.

It is now believed readily apparent that the present invention provides an electric light fixture and programmable electric circuit combined into a unitary structure for enabling the candle to automatically operate at preselected times and durations. It is an electric light fixture which is of relatively simple construction and capable of easy assembly, maintenance and repair by relatively unskilled persons. It is an electric light fixture capable of being assembled into a plurality of such electric light fixtures where the support and electrical interconnection of the plurality of electric light fixtures enables the individual fixtures to be programmed to switch-on and switch-off at preselected intervals and to be quickly and easily removed or attached to a supporting structure.

Although, but one embodiment of the invention has been illustrated and described in detail, it is to be expressly understood that the invention is not limited thereto. Various changes can be made in the arrangement of parts without departing from the spirit and scope of the invention as the same will now be understood by those skilled in the art.

I claim:

1. An electric light fixture comprising:

(a) a circuit board of planar, elongated configuration;

(b) a programmable electronic timer circuit supported on said circuit board and connected to a source of electric power;

(c) a light bulb receptacle for receiving an electric programmable light bulb and electrically connected to the electronic timer circuit; and (d) a bracket of planar, elongated configuration and of lesser length than the circuit board and disposed in close spaced planar parallelism with the circuit board for supporting the circuit board and light bulb receptacle as a unitary structure.

2. The apparatus of claim 1 wherein said programmable electronic timer circuit includes contact terminals for connecting the circuit to the source of electrical power.

3. The apparatus of claim 1 wherein a sleeve of at least translucent material is disposed to surround the circuit board, light bulb receptacle and bracket.

4. The apparatus of claim 3 wherein said sleeve is closed at one end and opened at the opposite end and wherein said circuit board has a connector means for securing said closed end of the said sleeve to the circuit board.

5. The apparatus of claim 3 wherein said open end of said sleeve is receivable into the open end of a cup-shaped element and wherein a fastening means if provided to secure the cup-shaped element to said bracket.

6. An electric light fixture in combination with a support comprising:

(a) a circuit board of planar, elongated configuration;

(b) a programmable electronic timer circuit supported on said circuit board;

(c) a light bulb receptacle for an electric light bulb electrically connected to the electric timer circuit;

(d) a bracket of planar, elongated configuration disposed to extend adjacent to and in a plane parallel to said circuit board and in a plane normal to the plane of said support;

(e) said bracket having a flanged end portion extending adjacent to and in coplanar relationship to said support;

(f) a first fastening means for securing said circuit board and light bulb receptacle to said bracket; and (g) a second fastening means for securing said flanged end portion of said bracket to said support so that the circuit board extends in a plane normal to the said support.

7. The apparatus of claim 6 wherein a translucent sleeve is disposed to surround said circuit board, bracket and light bulb receptacle and wherein a connector means is provided to secure the sleeve to said circuit board.

8. The apparatus of claim 7 wherein a cup-shaped element having an open-end and closed end portion is disposed with its closed end portion between said flanged end portion of the bracket and the support so that said second fastening means secures both the cup-shaped element and the bracket to the support. Please add the following claims:

9. An electric light fixture comprising:

(a) a circuit board of planar, elongated configuration;

(b) a programmable electronic timer circuit supported on said circuit board and connected to a source of electric power;

(c) a light bulb receptacle for receiving an electric programmable light bulb and electrically connected to the electronic timer circuit;

(d) a bracket of planar, elongated configuration and of lesser length than the circuit board and disposed in close spaced planar parallelism with the circuit board for supporting the circuit board and light bulb receptacle as a unitary structure; and (e) wherein a sleeve of at least translucent material is disposed to surround the circuit board, light bulb receptacle and bracket; and (f) wherein said circuit board has a connector means for securing one end of said sleeve to the circuit board.

10. The apparatus of claim 9 wherein said sleeve is closed at one end and opened at the opposite end and wherein said circuit board has a connector means for securing said closed end of the said sleeve to the circuit board.

11. The apparatus of claim 10 wherein said opened end of said sleeve is receivable into the opened end of a cup-shaped element and wherein a fastening means is provided to secure the cup-shaped element to said bracket.

* * * * *